United States Patent [19]

Ward

[11] 4,302,259

[45] Nov. 24, 1981

[54] $MGH_2$ AND $SR(NO_3)_2$ PYROTECHNIC COMPOSITION

[75] Inventor: Joseph R. Ward, Bel Air, Md.

[73] Assignee: The United States of America as represented by the Secretary of the Army, Washington, D.C.

[21] Appl. No.: 89,832

[22] Filed: Oct. 31, 1979

[51] Int. Cl.[3] ..... C06B 31/02

[52] U.S. Cl. ..... 149/61; 149/22; 149/87; 149/116; 102/374; 102/513; 102/335

[58] Field of Search ..... 149/22, 61, 87, 116; 102/49.3, 60, 87

[56] References Cited

U.S. PATENT DOCUMENTS

| | | | |
|---|---|---|---|
| 2,963,356 | 12/1960 | Guth | 149/22 |
| 3,053,710 | 9/1962 | Osborn et al. | 149/61 |
| 3,069,300 | 12/1962 | Damon et al. | 149/22 |
| 3,088,857 | 5/1963 | Matusewicz | 149/116 |
| 3,203,171 | 8/1965 | Burke et al. | 149/22 |
| 3,257,801 | 6/1966 | Martinez et al. | 149/61 |
| 3,351,505 | 11/1967 | Shapiro et al. | 149/22 |
| 3,390,026 | 6/1968 | Cerych et al. | 149/87 |
| 3,788,908 | 1/1974 | Lehikoinen et al. | 149/87 |
| 3,844,856 | 10/1974 | Flynn et al. | 149/19.2 |
| 4,012,244 | 3/1977 | Kaufman et al. | 149/19.3 |
| 4,130,061 | 12/1978 | Boggs et al. | 102/60 |

FOREIGN PATENT DOCUMENTS

| | | | |
|---|---|---|---|
| 340076 | 12/1975 | Sweden | 102/49.3 |

OTHER PUBLICATIONS

Misra et al., *Labdev J. Sci. Tech.,* vol. 8-A, No. 4, p. 220 (Oct. 1970).

*Primary Examiner*—Edward A. Miller
*Attorney, Agent, or Firm*—Nathan Edelberg; Robert P. Gibson; A. Victor Erkkila

[57] ABSTRACT

An improved pyrotechnic fuel composition comprising a metal fuel and a conventional pyrotechnic oxidizer for producing light, heat, smoke and sound through an exothermic reaction wherein the improvement comprises the use of a metal hydride as the fuel ingredient to produce a pyrotechnic composition which readily ignites and which has a lower burning rate for increased luminous intensity. The metal hydride fuel is preferably selected from the group consisting of magnesium hydride, titanium hydride, sodium borohydride and a lithium aluminum hydride.

2 Claims, No Drawings

$MGH_2$ AND $SR(NO_3)_2$ PYROTECHNIC COMPOSITION

DEDICATORY CLAUSE

The invention described herein may be manufactured, used, and licensed by or for the Government for governmental purposes without the payment to me of any royalty thereon.

BACKGROUND OF THE INVENTION

The invention relates to an improved fuel for use in pyrotechnic mixes which provides improved ignition rates and increased burning time without reduction in luminous intensity.

Pyrotechnic compositions produce light, heat, smoke or sound from an exothermic chemical reaction between a fuel and an oxidizer. Additives or modifiers have also been included to produce more saturated colored flames, to adjust burning rates, to produce colored smoke clouds, and to increase storage life and processing safety.

Pyrotechnic devices, which are employed in numerous munitions, have most commonly used magnesium and aluminum fuels since they are inexpensive, readily available and produce a large quantity of heat when they react with an oxidizer to form magnesium oxide and aluminum oxide, respectively. Pyrotechnic mixes with magnesium or aluminum, however, are difficult to ignite due to the high thermal conductivity of the metal, which tends to spread the energy from the ignition source away from the surface of the pyrotechnic and into the interior of the mix.

Once ignited, mixes with high percentages of metal burn faster than desirable, particularly with tracers and flares which are designed to be fuel-rich since their luminous intensity is augmented when aluminum or magnesium is vaporized and burned in air. Thus, the best flare is one with the maximum metal that can be vaporized, but as luminous intensity increases to a maximum, there is a corresponding increase in buring rate, which impairs efficiency. A conventional burning magnesium-sodium nitrate flare mix achieves maximum luminous intensity at approximately 72 percent by weight magnesium, as shown in the table below, but the rate of burning also increases to a maximum.

TABLE

Luminous Intensity and Burning Rate for a Series of Binary Magnesium-Sodium Nitrate Mixtures

| Mg Content, percent by weight | Luminous Intensity, candles/cm$^2$, $\times 10^{-3}$ | Burning Rate cm/s |
|---|---|---|
| 20 | 0.70 | 6.1 |
| 30 | 6.0 | 19.6 |
| 42 | 15.8 | 33.3 |
| 46 | 24.0 | 39.6 |
| 50 | 27.9 | 41.9 |
| 60 | 59.8 | 67.8 |
| 70 | 106.2 | 99.1 |
| 75 | 121.7 | 109.2 |
| 80 | 88.4 | 109.2 |
| 85 | 69.0 | 81.3 |

Applicant's novel pyrotechnic composition has succeeded in providing a metal which makes the pyrotechnic easier to ignite and which burns slower so that a high luminous intensity can be maintained over a longer period of time than that achieved in conventional metal fuel pyrotechnics.

SUMMARY OF THE INVENTION

An improved pyrotechnic composition having a metal pyrotechnic fuel and an oxidizer for producing light, heat, smoke and sound from an exothermic reaction wherein the improvement comprises the use of a metal hydride as the pyrotechnic fuel to provide rapid ignition and reduced burning rates with high metal content for increased luminous efficiency. The metal hydride fuels are selected from groups consisting of magnesium hydride ($MgH_2$), titanium hydride ($TiH_2$), lithium aluminum hydride ($LiAlH_4$) and sodium borohydride ($NaBH_4$).

The principal object of this invention is to provide an improved pyrotechnic composition of increased luminous efficiency which is easier to ignite and which has a reduced pyrotechnic burning rate with high metal content.

It is another object of this invention to provide an improved pyrotechnic fuel comprising a metal hydride for use in artillery, tank cannon and small arms projectiles.

It is a further object of this invention to provide an improved pyrotechnic fuel ingredient for use in rocket motor igniters to provide more reliable ignition than conventional known based igniters.

It is a still further object of this invention to provide an improved pyrotechnic fuel mix for use in the base of projectiles as "fumers" or "based-bleed" materials to reduce the projectile's base drag for easier ignition and higher specific impulse than conventional fuel mixes.

It is another object of this invention for an improved fuel for use in solid fuel ramjet for easier ignition and higher specific impulse than conventional magnesium based fuels.

It is also an object of this invention to provide a pyrotechnic mixture for use in flares and tracer shell mixes to provide increased luminous efficiency.

These and other objects of the invention will become apparent from the following detailed description of the invention.

DESCRIPTION OF THE INVENTION

The improved pyrotechnic composition and method of this invention involves the substitution of metal hydrides for the free metals conventionally employed as fuels in pyrotechnic devices. In particular, metal hydrides such as magnesium hydride, titanium hydride, lithium aluminum hydride, and sodium borohydride have been found to give easier ignition and slower burning rates than the corresponding free metals, magnesium, aluminum, titanium and boro which have previously been employed with an oxide in pyrotechnic devices. The hydrogen released during the combustion serves as a supplemental fuel.

The metal hydride fuel ingredients of this invention are employed in powder form and mixed with a conventional oxidizer such as potassium nitrate, sodium nitrate or strontium nitrate, in a manner similar to that employed in conventional pyrotechnic devices.

Metal hydrides have been found to offer the advantages of easier ignition and slower burning rates when used in conventional pyrotechnic compositions. The thermal conductivity of the hydride, a covalent salt, is much lower than that of the free metals. The hydride decomposes into the free metal and hydrogen before reaction with the oxidizer of the pyrotechnic mixture. This endothermic decomposition lowers the surface temperature of the pyrotechnic and thus retards the rate of burning. Since the product of endothermic decomposition is the free metal, all desirable qualities of present pyrotechnic, e.g., luminous intensity and specific impulse, are retained.

The key element of the invention is that the performance of the pyrotechnic mix, particularly illuminating flares and tracers, are enhanced since much higher percentages of metal., i.e., of the order of 70–80% by weight metal, can be incorporated in the mix with concomitant ease of ignition and reduction of burning rate. Both of these features are desirable for improved pyrotechnic performance. Thus, the reliability of existing tracer mixes has been enhanced by substituting $MgH_2$ directly for Mg, $TiH_2$ for Ti; $LiAlH_4$ and $AlH_3$ for Al; $ZrH_2$ for Zr; and $NaBH_4$ for B.

The following examples illustrate the advantages of specific metal hydride pyrotechnic mixtures of this invention.

EXAMPLES

The ease of ignition of metal hydride pyrotechnic mixes was demonstrated in wind tunnel tests which simulated tracer rounds to learn why tracers have lower drag coefficients than non-tracing projectiles. The pyrotechnic mix was pressed into the base of the wind tunnel model and was ignited with a laser after a MACH 2 flow was established in the tunnel. Earlier tests of standard tracer compositions under conditions of MACH 2 showed ignition was more difficult than under static air conditions. It was found that binary mixes of sodium borohydride ($NaBH_4$) and strontium nitrage ($Sr(NO_3)_2$), a conventional oxidizer, would ignite even when used in concentration of up to forty percent by weight sodium borohydride. Pure boron (B), on the other hand, failed to ignite and/or burn smoothly under wind tunnel conditions at concentration as little as fifteen percent by weight of boron.

Laboratory bench tests of pyrotechnic ignition showed qualitatively that magnesium hydride and titanium hydride were easier to ignite than binary mixes containing pure magnesium or titanium. As a comparison, typical ignition delay for pure metal magnesium with the oxidizer potassium perchlorate is shown in the table below.

IGNITION DELAY TIME FOR BINARY MAGNESIUM-POTASSIUM PERCHLORATE MIXES

| Mg Content Percent by Weight | Ignition Delay s |
|---|---|
| 41.3 | 0.8 |
| 57.7 | 1.3 |
| 74.2 | 2.2 |

The lower burning rate of the metal hydrides of this invention at high metal contents was tested by using pressed strands approximately one-inch long of magnesium hydride and strontium nitrate, a common oxidizer in tracer mixes. The results are summarized in the following table:

CONSOLIDATED BURNING RATES FOR BINARY $MgH_2$ or Mg—$Sr(NO_3)_2$ MIXES

| Metal Content, percent by weight | Burning Rate, cm/s $MgH_2$ | Burning Rate, cm/s Mg |
|---|---|---|
| 100 | 0.03 | — |
| 70 | .12 | 1.2 |
| 50 | 1.1 | 0.9 |
| 33.3 | 0.74 | .3 |
| 10 | .13 | — |

From the above table, it can be seen that the 70/30 $MgH_2$—$Sr(NO_3)$ mix burns ten times slower than the corresponding pyrotechnic mix using pure Mg. Thus, the efficiency of the pyrotechnic would be ten times greater, since the luminous intensity of the pyrotechnic would be unchanged while the burning time is increased tenfold.

The novel metal hydride pyrotechnic composition of this invention render pyrotechnics easier to ignite and reduce burning rates with high metal content. Thus, the lower burning rates of the metal hydride have increased luminous efficiency when used in illuminating flares and tracer ammunition mixes. In particular, magnesium hydride fuel when used in artillery, tank cannon and small arms projectile gave easier ignition, and provides higher luminous intensity for large range visibility than conventional magnesium loaded tracers.

Sodium borohydride, when used as a fuel ingredient in rocket motor igniters, has been found to give more reliable ignition than conventional boron-based igniters.

The metal hydrides $MgH_2$, $TiH_2$, $LiAlH_4$ and $NaBH_4$ have been used as fuel ingredients in pyrotechnic mixes in the base of projectiles to burn and reduce the projectile's base drag. The metal hydrides, when used in this manner as "fumers" or based-bleed" provide easier ignition and higher specific impulse than the conventional magnesium fuel presently used by the United States Air Force (GAU-8) and Sweden. These metal hydrides similarly provide higher specific impulse than magnesium fuels in solid fuel ramjet applications.

The metal hydride pyrotechnic fuels would have unlimited application to all present types of pyrotechnic devices and application, a list of which is provided in the following table from the Engineering Design Handbook, Military Pyrotechnics Series, Part One-Theory and Application, AMC Pamphlet 706–185 (US Department of the Army), April 1967.

Tabulation of Pyrotechnic Devices

1. Flares
   a. Reconnaissance
   b. Observation
   c. Bombardment
   d. Deplaning and emplaning of troops and material
   e. Prevention of enemy infiltration or reconnaissance
   f. Target identification
   g. Battlefield illumination
   h. Marking targets and bomb release lines
   i. Emergency airstrip location and identification
   j. Decoys
   k. Missile tracking
2. Signals
   a. Between various elements of ground troops
   b. Between ground troops and planes, or vice versa
   c. Between planes in the air
   d. Search and rescue operations (locate survivors)

e. Submarine to surface or air
f. Precision location of point or time in space for assessment of missile function
g. Establishment of points on a trajectory 3. Colored and White Smokes
a. For daytime signaling
b. For screening
c. For spotting
d. For marking targets
e. Thermal attenuating screen
f. Dissemination of chemical agents
g. Tracking and acquisition
h. Rescue 4. Tracers
a. To trace trajectories of projectiles or rockets
b. For self-destruction of ammunition after a definite time interval 5. Incendiaries
a. For use against ground targets
b. For use against aircraft targets
c. For emergency document and equipment destruction 6. Pyrotechnic Delays
Time delay for explosive trains 7. Photoflash Bombs and Cartridges
Aerial night photography 8. Spotting and Tracking
9. Atmosphere and Space Studies
10. Simulated Ammunition for Troop Training
11. Rocket Igniters
12. Fuel Igniters for Ramjet Engines and Guided Missiles
13. Aircraft Engine Igniters
14. Water Markers
15. Heat Sources
16. Special Devices The preferred metal hydride fuel of this invention for use in most pyrotechnic compositions can be $MgH_2$ since it readily ignites and exhibits the lowest thermal conductivity for slower burning. The specific amounts of the metal hydride fuel used in the pyrotechnic mixtures of the invention are not critical and can be varied to obtain the luminous intensity and burning rate desired for the specific application for which the pyrotechnic is intended, e.g., as a tracer, flares, incendiaries and the like. The composition of the desired pyrotechnic mix can thus be determined by accepted design criteria for metal content of the pyrotechnic device and can be varied within the skill of one in the art. The particular advantage of the metal hydride fuel of this invention is that, unlike free metal fuel, it can be used to provide a pyrotechnic metal content of up to 70–80% by weight of the mixture for increasing luminous intensity. Conventional free metal pyrotechnic fuels have been limited by burning rate and ignition requirements to a metal content in the range of 20–30% by weight of the pyrotechnic mixture.

Any conventional pyrotechnic oxidizer which, when added to a metal fuel, will produce an exothermic chemical reaction of sufficient luminous intensity for use in a pyrotechnic device, can be used in the pyrotechnic mixture of the instant invention. The oxidizers used in the pyrotechnic composition of this invention are typically selected from conventional pyrotechnic oxidizers such as nitrates, nitrites, chlorates, chlorites and perchlorates and are not considered to be a critical part of the invention. Thus, the preferred pyrotechnic oxidizers are those most commonly used in pyrotechnic device, namely, potassium perchlorate, sodium nitrate and strontium nitrate.

The pyrotechnic composition of this invention may also be used with conventional additives or modifiers conventionally used in metal pyrotechnic mixes for producing more saturated colored flames, adjusting burning rates; producing colored smoke clouds and increasing storage life and processing safety.

The metal hydride-oxidizer pyrotechnic mixture of this invention is prepared by mixing the metal hydride, in powder form, with the oxidizer in the same manner as used for conventional metal-oxidizer pyrotechnics and the resulting mixture can be used in exactly the same manner as conventional pyrotechnic fuel mixtures.

The metal hydride fuel pyrotechnic mixture of this invention has succeeded in providing a high metal content pyrotechnic which is easily ignited and which has a longer burning time to give increased luminous intensity over that obtained with conventional free metal fuel pyrotechnic mixtures.

The foregoing disclosure is merely illustrative of the principles of this invention and is not to be interpreted in a limited sense. Applicant does not desire to be limited to the exact details of construction shown and described because obvious modifications will occur to one skilled in the art.

I claim:

1. A method for reducing the base drag of a tracer projectile, which comprises incorporating in the base of said projectile a pyrotechnic tracer composition consisting essentially of about 70% by weight of magnesium hydride and about 30% by weight of strontium nitrate.

2. A pyrotechnic composition consisting essentially of about 70% by weight of magnesium hydride and about 30% by weight of strontium nitrate.

* * * * *